US006066403A

United States Patent [19]

Sherwood et al.

[11] Patent Number: 6,066,403

[45] **Date of Patent: *May 23, 2000**

[54] METALS HAVING PHOSPHATE PROTECTIVE FILMS

[75] Inventors: Peter M. A. Sherwood; John A. Rotole, both of Manhattan, Kans.

[73] Assignee: Kansas State University Research Foundation, Manhattan, Kans.

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,946

[22] Filed: Dec. 15, 1997

[51] Int. Cl.[7] ..... B32B 9/00; B41M 5/20; C25D 5/34; C23C 8/36

[52] U.S. Cl. ..... 428/472.3; 205/50; 205/210; 205/212; 205/213; 205/216; 205/217; 205/318; 148/241; 428/457; 428/704

[58] Field of Search ..... 205/50, 210, 212, 205/213, 215, 216, 217, 318; 148/241; 428/472.3, 457, 704

[56] References Cited

U.S. PATENT DOCUMENTS

| | | | |
|---|---|---|---|
| 3,615,893 | 10/1971 | Matsushima et al. | 148/6.152 |
| 3,841,927 | 10/1974 | Florence et al. | 148/189 |
| 3,998,668 | 12/1976 | Florence et al. | 148/22 |
| 4,015,050 | 3/1977 | Birchall et al. | 428/480 |
| 4,225,398 | 9/1980 | Hasegawa et al. | 204/33 |
| 4,302,074 | 11/1981 | Fleming et al. | 350/96.34 |
| 4,375,496 | 3/1983 | Nowakowski et al. | 428/403 |
| 4,477,290 | 10/1984 | Carroll et al. | 148/6 |
| 4,526,671 | 7/1985 | Watanabe et al. | 204/37.6 |
| 4,878,963 | 11/1989 | Bibber | 148/262 |
| 4,893,759 | 1/1990 | Mizobata | 241/100 |
| 4,990,278 | 2/1991 | Wyeth | 252/70 |
| 5,039,361 | 8/1991 | Hauffe et al. | 148/253 |
| 5,221,370 | 6/1993 | Jo et al. | 148/250 |
| 5,401,381 | 3/1995 | Seidel et al. | 205/177 |
| 5,462,634 | 10/1995 | Kamiyama et al. | 216/85 |
| 5,603,818 | 2/1997 | Brent et al. | 204/488 |
| 5,645,706 | 7/1997 | Matsuda | 205/82 |
| 5,824,371 | 10/1998 | Epstein et al. | 427/388.1 |

OTHER PUBLICATIONS

Lowenheim, "Chemical Preparation for Finishing", Electroplating, pp. 67–73, no month available, 1978.

Grande et al., Aluminum Mirror Coatings in Space: A Study of the Decrease in Ultraviolet Normal Incidence Reflectance Produced by Controlled Oxidation of Evaporated Aluminum Mirror Surfaces, (1986) no month available.

Augustynski et al., *Chemical Physical Letters*, 44(2):221–224 (1976) no month available.

Textor et al., *Corrosion Science*, 23(1):41–53 (1983) no month available.

Gunter et al., *Surface and Interface Analysis*, 19:161–164 (1992) no month available.

Hoar et al.; *Nature*, vol. 240 (Dec. 1, 1972).

Sherwood; Extracting more chemical information from x–ray photoelectron spectroscopy by using monochromatic X–rays; *J. Vac. Sci. Technol.* A 15(3):520–525 (1997) no month available.

(List continued on next page.)

*Primary Examiner*—Kathryn Gorgos
*Assistant Examiner*—Edna Wong
*Attorney, Agent, or Firm*—Hovey, Williams, Timmons & Collins

[57] ABSTRACT

Novel metallic bodies are provided which present an essentially oxide-free surface protected by phosphate groups which directly and chemically bond to surface metal atoms. Metal surfaces such as Al or Fe can be protected by deposition of a phosphate film directly onto etched metal surfaces without intermediate naturally occurring oxides between the metal ions and protective phosphate groups. Preferably, metallic surfaces to be protected are first etched to remove oxides and other contaminants, followed by electrochemical treatment with a phosphate electrolyte to generate a protective film having a thickness of from about 20–100 Å which is stable in ambient air.

22 Claims, 8 Drawing Sheets

OTHER PUBLICATIONS

Thomas et al.; Valence Band Spectra of Aluminum Oxides, Hydroxides and Oxyhydroxides Interpreted by Xα Calculations; *Anal. Chem.*, 64:2488–2495 (1992) no month available.

Welsh et al.; Valence Band Photoemission Studies of corrosion Inhibitor Action on Iron Surfaces: Effect of Etidronate; *Chem. Mater.* 4:133–140 (1992) no month available.

Sherwood; Photoelectron Spectroscopic Studies of Electrode and Related Surfaces; Chemical Society Reviews; vol. 14, No. (1985) no month available.

Liang et al.; core and Valence Band Photoelectron Spectroscopic Studies of Nickel Oxidation in an Anaerobic Liquid Cell; *Anal. Chem.*, 65:2276–2281 (1993) no month available.

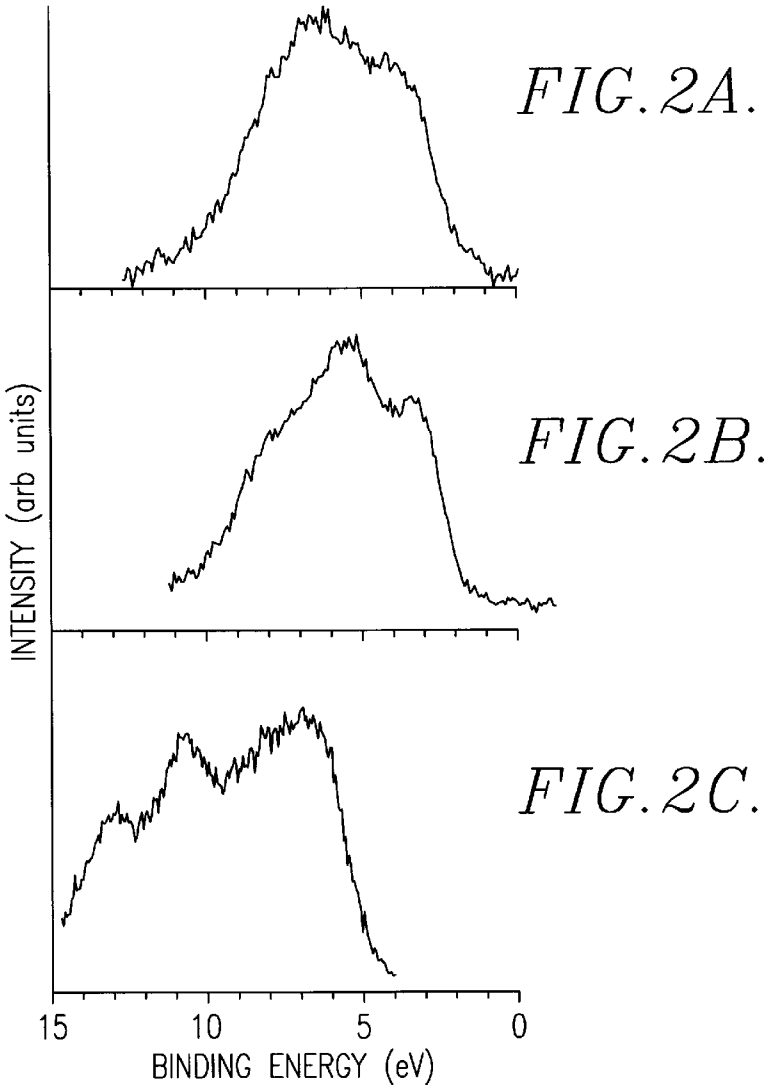
FIG. 2A.
FIG. 2B.
FIG. 2C.
INTENSITY (arb units)
15
10
5
0
BINDING ENERGY (eV)
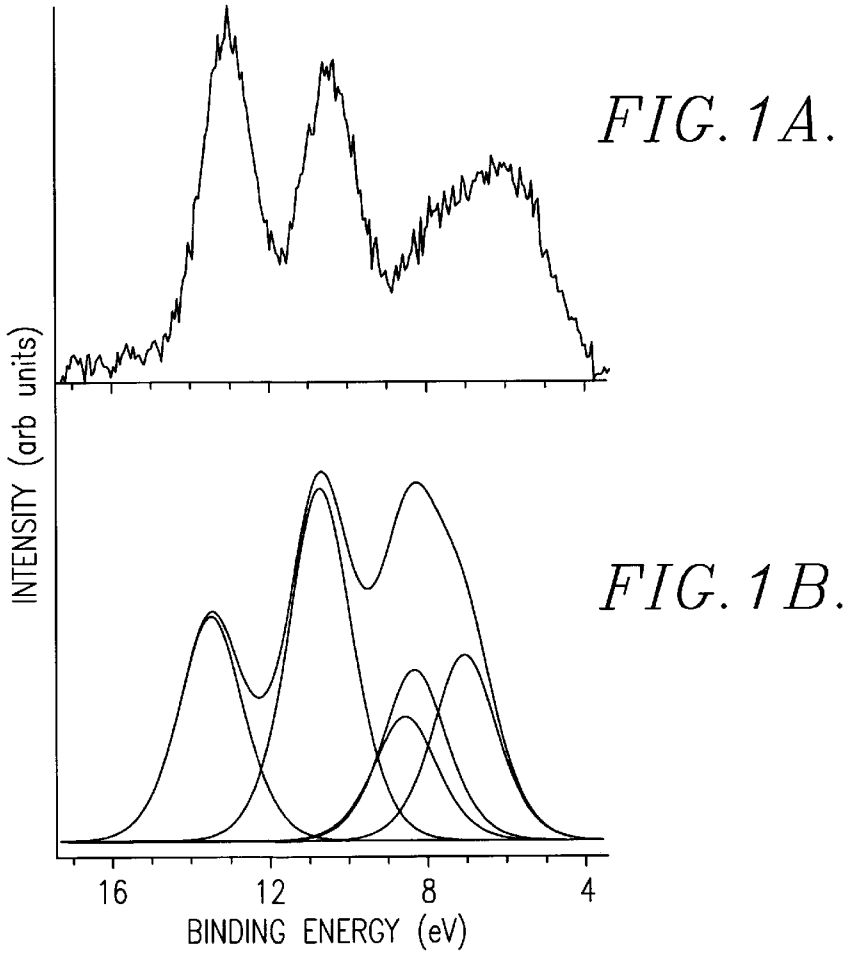
FIG. 1A.
FIG. 1B.
INTENSITY (arb units)
16
12
8
4
BINDING ENERGY (eV)

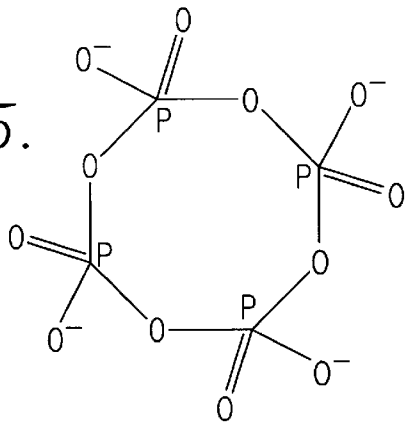
FIG. 5.
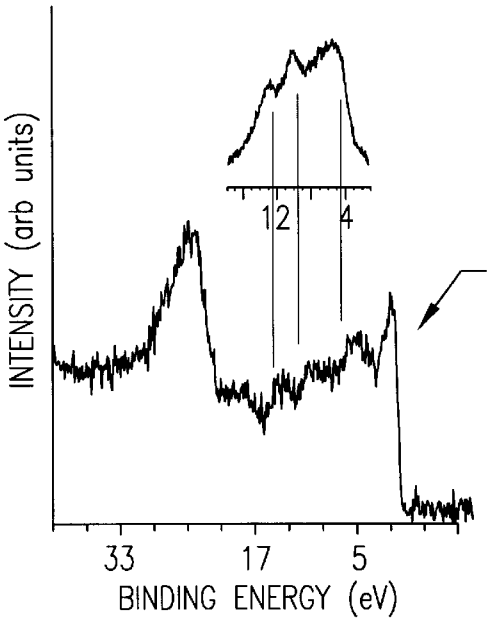
FIG. 9A.
FIG. 9B.
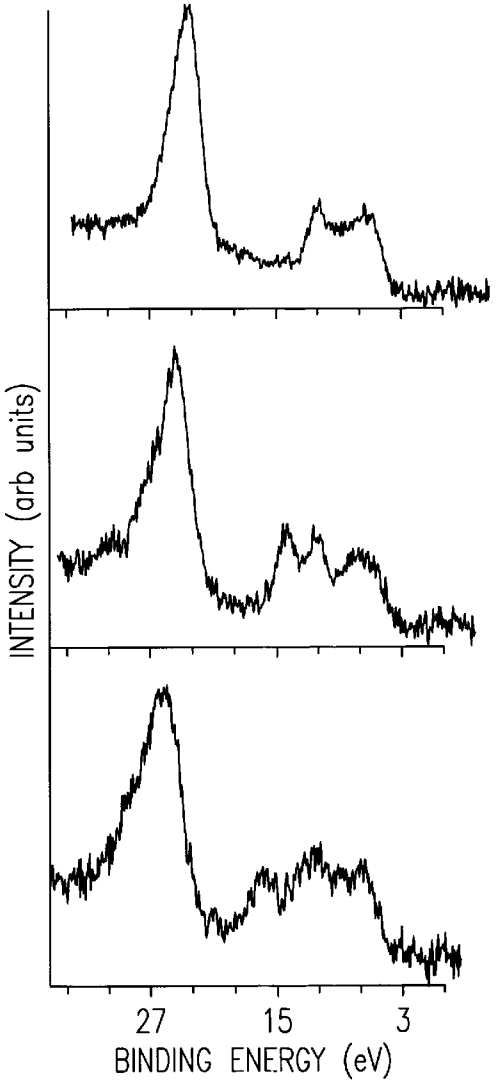
FIG. 3A.
FIG. 3B.
FIG. 3C.

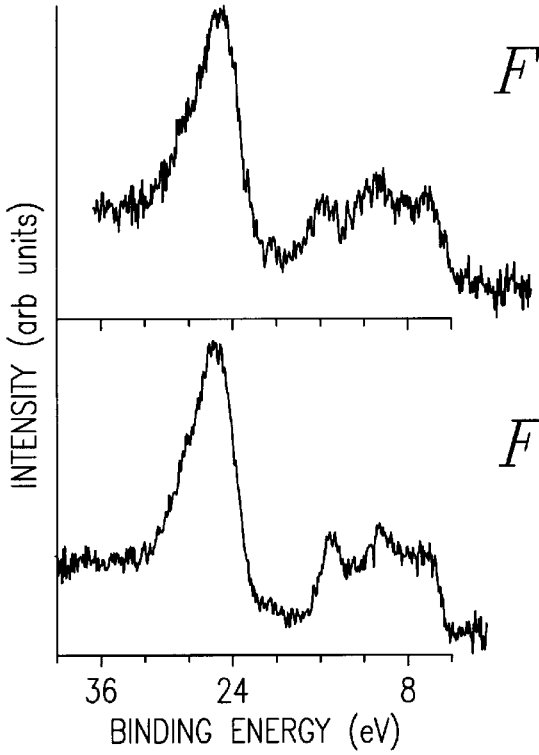
FIG. 6A.
FIG. 6B.
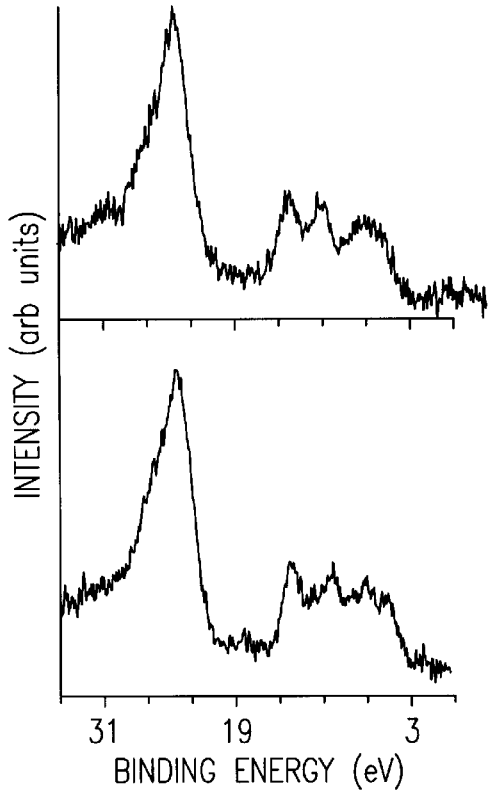
FIG. 7A.
FIG. 7B.

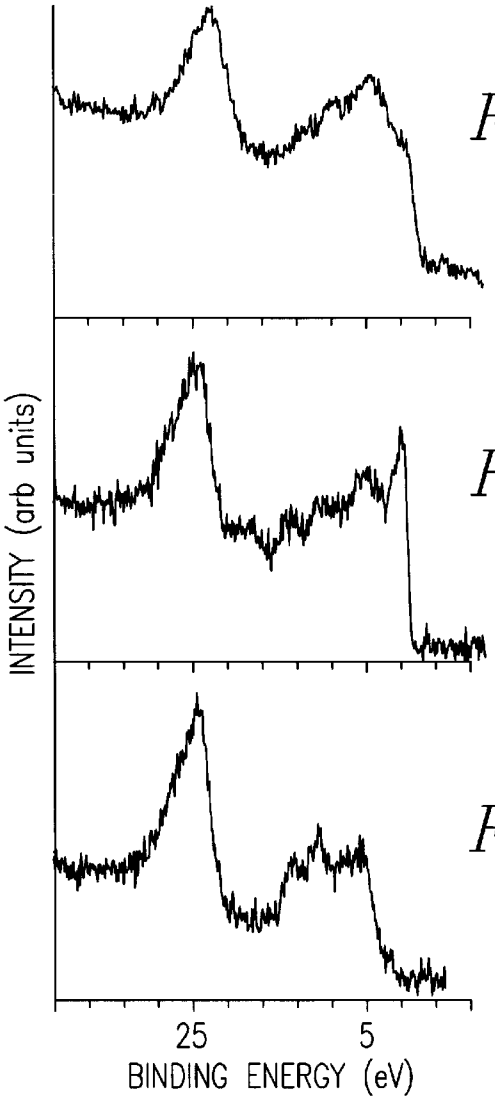
FIG. 11A.
FIG. 11B.
FIG. 11C.
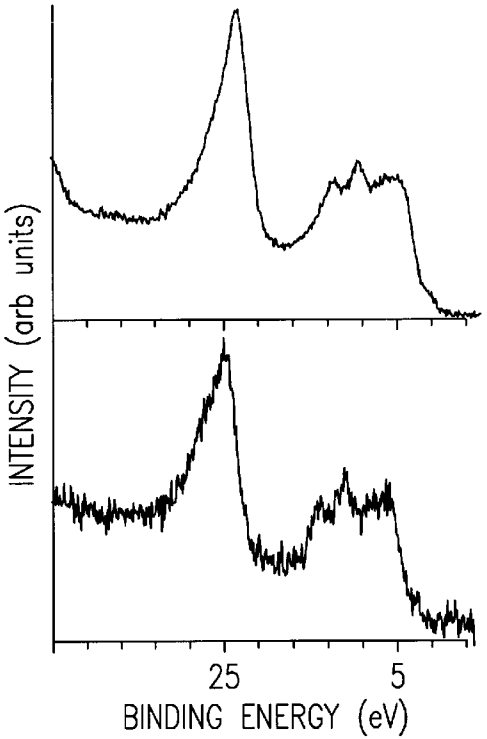
FIG. 10A.
FIG. 10B.

METALS HAVING PHOSPHATE PROTECTIVE FILMS

FEDERALLY SPONSORED RESEARCH/ DEVELOPMENT

This invention was made with government support under Grant No. CHE9421068 awarded by the National Science Foundation. The government has certain rights in the invention.

BACKGROUND OF THE INVENTION

1. Field of the Invention

The present invention is broadly concerned with improved metal-containing bodies having a surface presenting metal surface atoms, with at least some of the metal atoms being directly chemically bonded with non-naturally occurring heterologous protective groups and especially phosphate groups in the absence of metal oxide between the metal atoms and the protective groups, so as to provide a novel, stable protective film rendering the metal surface resistant to corrosion and the like. More particularly, the invention pertains to protected bodies of this type, as well as a method of producing the same, wherein the surface metal atoms are selected from the group consisting of the first and second row of transition metals, the rare earth metals, Hf, Ta, W, Re and the metals of Group III (preferably Al and Fe) and wherein a non-naturally occurring phosphate layer is directly bonded to such metal atoms and having a thickness of from about 20–100 Å.

2. Description of the Prior Art

Nearly every metal known (with the exception of gold) reacts in the atmosphere to form a naturally occurring oxide surface film, usually in combination with outer surface layers of hydroxide or bound molecular water. If a metallic surface bearing such an oxidized film is scratched or the oxidized film is removed in some other fashion, the metal will immediately reoxidize in air.

There have been many studies of corrosion films formed on metal surfaces, especially in the case of thick corrosion films that can be analyzed by bulk surface techniques. Other studies using ultra-high vacuum surface analysis probes have examined the role of corrosion inhibitors in modifying oxide surface films. Thus a body of literature exists regarding corrosion inhibitors which detail the changes resulting from potentially corrosion-inhibiting treatments or the formation of protective films over the naturally occurring oxide films. Phosphate treatments have a long history of effective action as corrosion inhibitors, but in all cases the phosphate treatments are applied over naturally occurring oxides, or at least have such oxides as intermediaries between the metal surface atoms and the phosphate protectants.

SUMMARY OF THE INVENTION

The present invention represents a distinct departure from prior metal protectants in that the invention provides non-naturally occurring phosphate groups directly chemically bonded to the surface of metals, without any intervening metal oxides between the phosphate groups and the surface metal atoms. The resultant phosphate films are extremely stable in ambient atmosphere and essentially prevent typical oxidation of the metal surfaces. Thus, the invention provides a unique type of protectant film to minimize the tendency of corrosion or other degradation of metal surfaces.

The film-coated bodies of the invention may consist entirely of metal, or may merely present one or more metallic surfaces and otherwise be formed of non-metallic materials. The protected metals should be selected from the group consisting of the first and second rows of transition metals (Sc, Ti, V, Cr, Mn, Fe, Co, Ni, Cu, Zn, Y, Zr, Nb, Mo, Tc, Ru, Rh, Pd, Ag and Cd), the rare earth metals (La, Ce, Pr, Nd, Pm, Sm, Eu, Gd, Tb, Dy, Ho, Er, Tm, Yb and Lu), Hf, Ta, W and Re, and the metals of Group III (Al, Ga, In and Tl). The more preferred metals in accordance with the invention are Ti, Fe, Co, Ni, Cu, Zn and Al, with the most preferred metals being Al and Fe.

Generally speaking, the phosphate films of the invention include phosphate groups having P and O atom(s) in various combinations which depend upon the particular chemistry of the metal in question and the method of film formation employed; thus monophosphate and condensed phosphate (e.g., pyrophosphates, metaphosphates and polyphosphates) films can be used. In the case of aluminum and iron surfaces, the mono and metaphosphates are typically formed.

The phosphate protective coatings of the invention preferably have a thickness of from about 20–100 Å, more preferably from about 20–60 Å. In the case of iron, the phosphate protective films generally have a range of from about 20–40 Å in thickness, while with aluminum, the films range from about 40–60 Å in thickness. The films should be stable in atmospheric air at ambient temperatures for a period of at least about 24 hours, and more preferably at least about 2 weeks. Stability in this context refers to the ability of the film to prevent any substantial formation of oxides on the protective metal surface owing to the presence in atmospheric air. In order to achieve desirable metal surface protection, at least about 75% (and more preferably at least about 95%) of the number of metal surface ions present on the surface to be protected are directly bonded to phosphate groups.

The phosphate films of the invention are advantageously formed on a metal surface by first removing oxides from the surface and then directly bonding the phosphate groups to a preponderance (i.e., at least about 50%) of the surface metal atoms. Preferably at least about 90% of the surface metal atoms should be free of any naturally-occurring oxide, and more preferably at least about 95% thereof, with these atoms having the phosphate protective groups bonded thereto. In order to assure such protective bonding of the phosphate groups, the phosphate/metal reaction is preferably carried out electrochemically and in an inert (e.g., nitrogen) atmosphere essentially free of oxygen.

Preferably, a given body presenting a metal surface to be protected is first treated by argon ion etching to remove all naturally occurring oxides and other contaminants. Argon ion etching is known, and is normally carried out in an ultra-high vacuum chamber under an initial pressure of from about $10^{-9}$ to $10^{-12}$ Torr, and more preferably from about $10^{-9}$ to $10^{-10}$ Torr. The etched metallic surface is then preferably placed in an electrochemical cell together with a platinum electrode and an aqueous phosphate electrolyte, in an essentially oxygen-free inert atmosphere. The etched metallic surface is then polarized for an appropriate period (generally ranging from about 1 min. to 1 hr., more preferably from about 5–20 min.) at from about 0.5 to −2 V with respect to a saturated calomel electrode (SCE). This serves to deposit or electrochemically form the desired phosphate film directly on the etched metallic surface in the absence of metal oxides.

BRIEF DESCRIPTION OF THE DRAWINGS

FIG. 1A is an XPS (X-ray photoelectron spectroscopy) valence band spectrum of (wherein "arb units" refers to arbitrary units) lithium phosphate powder wherein the spectrum was excited with achromatic Mg Kα radiation;

FIG. 1B is a calculated XPS valence band spectrum (wherein "arb units" refers to arbitrary units) of phosphate ion generated by Xα cluster calculation;

FIG. 2A is an XPS valence band spectrum (wherein "arb units" refers to arbitrary units) of iron hydroxide (FeOOH) powder wherein the spectrum was excited by achromatic Mg Kα radiation;

FIG. 2B is an XPS valence band spectrum (wherein "arb units" refers to arbitrary units) of iron III oxide ($Fe_2O_3$) powder wherein the spectrum was excited by achromatic Mg Kα radiation;

FIG. 2C is an XPS valence band spectrum (wherein "arb units" refers to arbitrary units) of ferric phosphate ($FePO_4.H_2O$) powder wherein the spectrum was excited by achromatic Mg Kα radiation;

FIG. 3A is an XPS valence band spectrum (wherein "arb units" refers to arbitrary units) of corundum ($\alpha$-$Al_2O_3$) powder excited by monochromatic Al Kα radiation;

FIG. 3B is an XPS valence band spectrum (wherein "arb units" refers to arbitrary units) of aluminum phosphate ($AlPO_4$) powder excited by monochromatic Al Kα radiation;

FIG. 3C is an XPS valence band spectrum (wherein "arb units" refers to arbitrary units) of aluminum metaphosphate ($Al(PO_3)_3$) powder excited by monochromatic Al Kα radiation;

FIG. 5 is representation of metaphosphate ion wherein the phosphorus atoms are members of the ring structure;

FIG. 6A is an XPS valence band spectrum (wherein "arb units" refers to arbitrary units) of aluminum metaphosphate ($Al(PO_3)_3$) powder;

FIG. 6B is an XPS valence band spectrum (wherein "arb units" refers to arbitrary units) of the aluminum metaphosphate ($Al_8(P_4O_{12})$) film formed on etched aluminum in accordance with the invention;

FIG. 7A is an XPS valence band spectrum (wherein "arb units" refers to arbitrary units) for aluminum phosphate ($AlPO_4$) powder;

FIG. 7B is an XPS valence band spectrum (wherein "arb units" refers to arbitrary units) of the phosphate film on an etched aluminum substrate in accordance with the invention, after exposure to ambient atmosphere;

FIG. 9A is an XPS valence band spectrum (wherein "arb units" refers to arbitrary units) for ferric phosphate ($FePO_4.H_2O$) powder;

FIG. 9B is an XPS valence band spectrum (wherein "arb units" refers to arbitrary units) for a ferric phosphate film formed on an etched iron substrate in accordance with the invention;

FIG. 10A is an XPS valence band spectrum (wherein "arb units" refers to arbitrary units) of ferric phosphate ($FePO_4.H_2O$) excited with achromic Mg Kα radiation;

FIG. 10B is an XPS valence band spectrum (wherein "arb units" refers to arbitrary units) of the ferric phosphate ($FePO_4.H_2O$) film formed on an etched iron substrate in accordance with the invention after 3 months in air;

FIG. 11A is an XPS valence band spectrum (wherein "arb units" refers to arbitrary units) of a multicomponent phosphate/oxide film formed in a conventional electrochemical cell using as received iron in 5.0M $H_3PO_4$ at −0.5 V for 10 minutes, wherein this spectrum was excited with achromic Mg Kα radiation;

FIG. 11B is an XPS valence band spectrum (wherein "arb units" refers to arbitrary units) for a ferric phosphate film formed on an etched iron substrate in accordance with the invention;

FIG. 11C is an XPS valence band spectrum (wherein "arb units" refers to arbitrary units) of the ferric phosphate ($FePO_4$.H2O) film formed on an etched iron substrate in accordance with the invention after 3 months in air;

DETAILED DESCRIPTION OF THE PREFERRED EMBODIMENT

Figure 14:
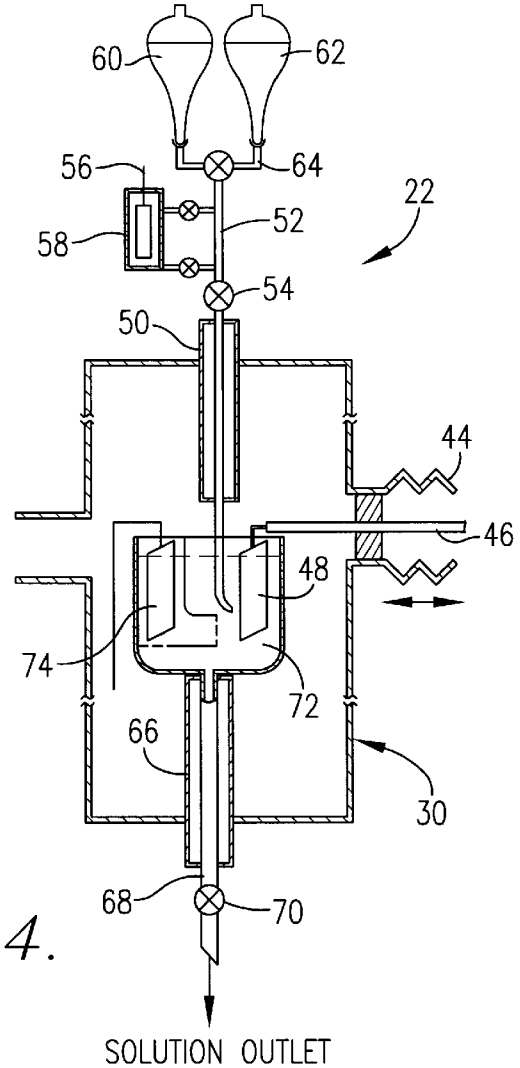
FIG. 14 is a fragmentary schematic representation illustrating the central zone of the anaerobic cell forming a part of the apparatus illustrated in FIG. 13, during electrochemical treatment of an etched metallic sample.
Figure 13:
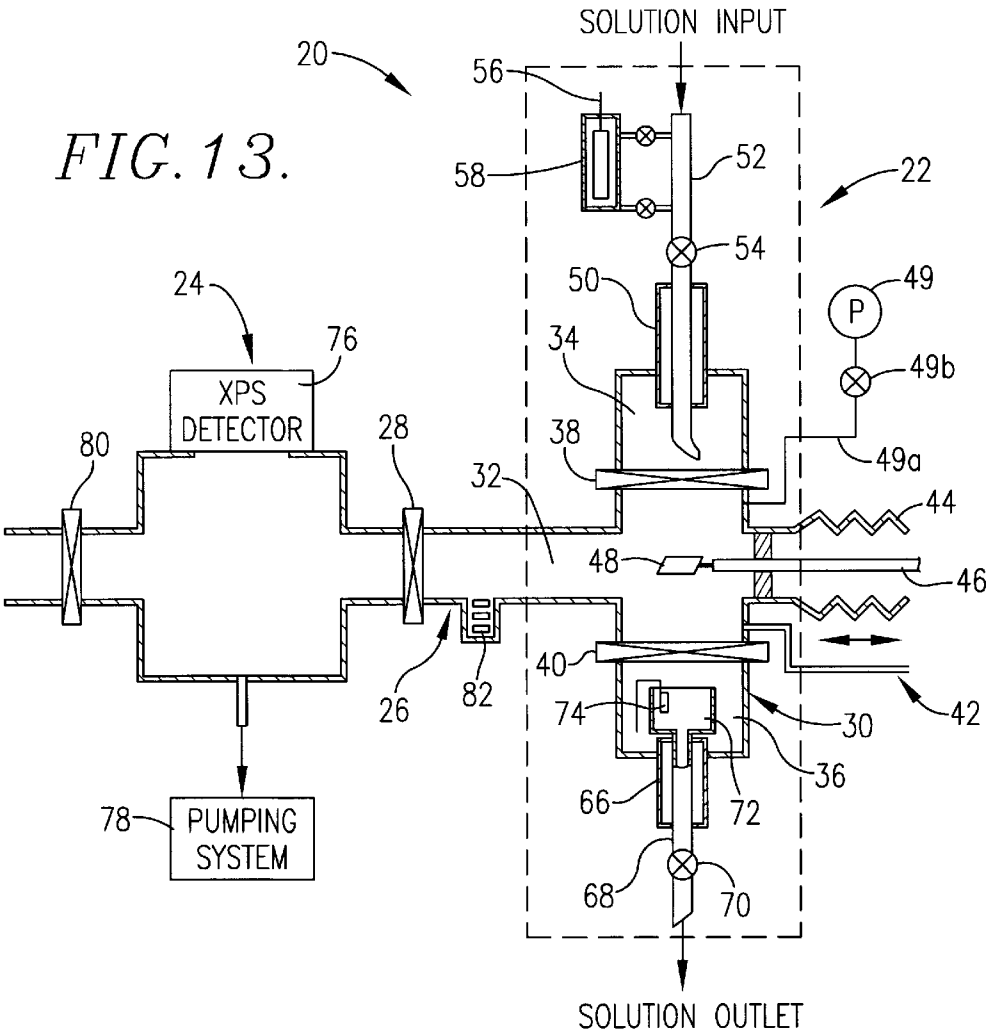
FIG. 13 is a schematic representation of the preferred apparatus for the etching, electrochemical treatment and spectral analyses of metallic substrates, using the techniques of the invention.

Turning first to FIGS. 13 and 14, preferred laboratory-scale apparatus 20 used in the production and analysis of the novel coated metal products of the invention is illustrated. Broadly speaking, the apparatus 20 includes an anaerobic treatment cell 22 and an XPS detection cell 24 interconnected via a common conduit 26. As shown in FIG. 13, the cells 22, 24 are separated by a gate valve 28 situated within conduit 26 so as to permit selective isolation of the respective cells.

The treatment cell 22 is in the form of an airtight chamber body 30 presenting a central treatment zone 32 and secondary zones 34, 36. The zones 34, 36 are selectively isolatable from the zone 32 via gate valves 38, 40, respectively. The central zone 32 of body 30 includes a gas inlet 42. An elongated operating rod 46, forming a part of a precision, motor-driven X, Y, Z manipulator (not shown) extends through the seal 44 and into the confines of zone 32 between the valves 38, 40. The rod 46 carries a sample 48 as shown. A UHV pumping system is coupled to the body 30 and includes a rotary pump (not shown) coupled with inlet 42, as well as a diffusion pump 49 coupled via line 49*a* and having valve 49*b* interposed therein.

The secondary zone 34 is equipped with an elongated, tubular, metallic, axially shiftable seal body 50 carrying a sealing O-ring (not shown) which slidably receives a LUG- GIN capillary 52 equipped with an in-line valve 54. The Luggin capillary 52 is operably coupled with a SCE reference electrode 56 housed within a chamber 58. A solution input to the LUGGIN capillary (see FIG. 14) includes a pair of reservoirs 60, 62 respectively for electrolyte and water, with the reservoir 60, 62 being connected via appropriate piping 64 to the upper end of the capillary 52.

The secondary zone 36 also includes an elongated, tubular, metallic, axially shiftable seal body 66 carrying sealing O-rings (not shown). The body 66 slidably receives an elongated liquid outlet tube 68 equipped with a valve 70. The upper end of tube 68 supports and communicates with an open-top electrochemical cell 72 having a platinum electrode 74 therein. An electrical connection with the SCE 56 is completed through the solution in the Luggin capillary 52.

The detection cell 24 is operatively coupled to conduit 26 as shown and includes a conventional XPS spectrometer 76 coupled thereto together with an ultra-high vacuum (UHV) pumping system 78. The end of cell 24 remote from conduit 26 is normally closed via gate valve 80.

As described above, the conduit 26 interconnects the cells 22, 24. In addition, an argon ion etching gun 82 (Ion Tech B21 Saddle Field Ion Etcher) is supported by conduit 26 adjacent valve 28 as illustrated.

Generally speaking, the use of apparatus 20 involves placement of sample 48 within primary zone 32 of body 30 at atmospheric pressure using axially shiftable body 50 to place the sample 48 on elongated operating rod 46 with cell 72 being retracted and with gate valves 28, 38 and 40 closed. The rotary pump associated with cell 22 is first actuated to evacuate the zone 32 to a low level, followed by operation of the diffusion pump 49 to further lower the pressure to the UHV range. The rod 46 is then manipulated to position sample 48 adjacent the etching gun 82 and the latter is activated to etch sample 48 for the removal of all oxides and other contaminants from the surface of the sample 48; from time to time, the sample 48 may be tested in the cell 24 as described below to insure that etching is carried out to the extent to essentially completely remove all oxides and other contaminants.

After the etching step is completed, the rod 46 is retracted to the central region of the zone 32, and high purity, oxygen-free nitrogen is then directed into the zone 32 thereby creating an inert atmosphere of atmospheric pressure or slightly above. The valves 38, 40 are then opened, and the LUGGIN capillary/sealing tube and electrochemical cell/sealing tube are each axially shifted to assume the general position depicted in FIG. 14 i.e., with the capillary oriented to deliver phosphate electrolyte to the cell 72 and the sample 48 and platinum electrode 74 within the cell beneath the liquid level therein. The cell 72 is next actuated to deposit on the surfaces of sample 48 an essentially oxide-free phosphate protective film, with the potential of the electrode held at a controlled level through use of a potentiostat. The capillary 52 and cell 74 are then withdrawn to their retracted positions, and the valves 38 and 40 are closed. Cell 32 is then evacuated with the rotary pump through inlet 42. The diffusion pump 49 is next utilized for a period of about 3–5 hours to reduce the pressure within the cell 22 to a UHV level essentially equal to that maintained in cell 24. Valve 28 is opened, and the rod 46 is employed to shift sample 48 into cell 24. At this point, the phosphate-coated sample can be analyzed by XPS.

Further details regarding the preferred apparatus described herein can be found in Liang et al., *Anal. Chem.*, 64:2276–2281 (1983), which is incorporated by reference herein.

EXAMPLE

In these examples, aluminum and iron foil were argon ion etched and electrochemically treated to establish an oxide-free phosphate protective coating on the surfaces of the aluminum and iron samples. These samples were then tested by XPS. Parallel experiments were performed wherein etched aluminum and iron samples were exposed to triply distilled water without any electrochemical treatment.

High purity research metals were used as substrate samples. 99.9999% aluminum was obtained from Alcan International and the 99.9975% iron foil was purchased from Alfa AESAR. XPS measurements were made with a VSW HA150 spectrometer (150 mm hemispherical analyzer), equipped with a 16 plate multichannel detector system and Al K$\alpha$ X-radiation (240 W) produced from a 32 quartz crystal VSW monochromator providing a line width of better than 0.2 eV. The base pressure of the system is better than $10^{-9}$ Torr. The spectrometer was operated in fixed analyzer transmission (FAT) mode with a pass energy of 44 eV for survey scans and 22 eV for both core level and valence band data. The spectrometer energy scale was calibrated using copper and all spectra were referenced against the C1s peak of adventitious hydrocarbon at 284.6 eV.

The Al and Fe foil samples were initially degreased with acetone and placed in the anaerobic cell 22 and subjected to argon ion etching to remove any native surface oxides or other contaminants. The cell 22 was evacuated to a UHV pressure of about $10^{-9}$ to $10^{-10}$ Torr using the rotary/diffusion pump system associated with the cell 22. The Ion Tech etcher was supplied with 99.99% ultra-high purity argon from Matheson and was operated at 2 mA and 5 KV with an argon pressure of less than $10^{-3}$ Torr to yield an etch rate which was estimated to be in the range of 2–5 Å $min^{-1}$. The aluminum foil sample was etched for 1.5 hours and the iron foil sample for 4 hours until the presence of oxide (as monitored by XPS) in the Al2p and Fe2p regions respectively was not detected. These etching times insured that the metal was completely free of oxides and other surface impurities.

After etching, each foil sample was moved into chamber 32, the valve 28 was closed and ultra high purity (99.99%) oxygen-free nitrogen was introduced into the cell to a pressure greater than atmospheric (<760 Torr). Each sample was then electrochemically treated by opening the valves 38, 40 of the chamber 22 and shifting the capillary 52 and cell 72 as described previously. 5.0M phosphoric acid electrolyte was used for these experiments and was prepared from triply distilled water deaerated with standard purity argon gas. The etched aluminum and iron electrodes were polarized for 10 minutes in the 5.0M phosphoric acid electrolyte at −0.5 V with respect to the SCE 56. Each sample was then rinsed with triply distilled water, the glassware removed and the anaerobic cell 22 was evacuated to UHV ($10^{-9}$ to $10^{-10}$ Torr). The gate valve 28 was then opened, and the electrochemically-treated sample was translated via rod 46 into the detection cell 24 (which is constantly maintained at UHV by means of pumping system 78) for characterization by XPS. The entire experimental procedure from the initial entry of high purity nitrogen into the ultra-high vacuum chamber containing the argonion etched metal, the placing of the glassware into the inert atmosphere positive pressure environment, the execution of the electrochemical experiments in this inert atmosphere, the removal of the glassware from the sample chamber, and the achievement of ultra-high vacuum again took roughly 30 minutes.

The XPS spectra of the pure oxide and phosphate substances were obtained from research grade powder samples. The corundum ($\alpha$-$Al_2O_3$) powder from Alfa and the aluminum metaphosphate and the aluminum phosphate powders from Aldrich were spread on double sided tape and mounted on a copper sample carrier. Extensive surface charging was negated with an low energy electron flood gun operated at 2.20 A and 275 V during spectral collection. No copper from the sample carrier was detected by XPS.

In another test, phosphate films were electrochemically formed in identical fashion, using the conventional electrochemical cell operated with deoxygenated water with nitrogen bubbled therethrough. In this test, the iron sample was placed in the electrochemical cell in its as received condition, i.e., without removal of the naturally occurring iron oxides. These spectra were excited using achromic Mg K$\alpha$ radiation at a power of 240 W on an AEI (Kratos) ES200B X-ray photoelectron spectrometer operated in FRR (fixed retardation ratio) mode. The spectrometer energy scale was calibrated using copper and all spectra were referenced against the C1s peak of adventitious hydrocarbon at 284.6 eV. The base pressure of the system is around $10^{-9}$ Torr.

The two metals examined are characterized by substantially different reactivities. Aluminum is a highly reactive metal that is normally protected from significant oxidation by an initially formed oxide layer which provides substantial protection from further oxidation. Iron on the other hand is not a very reactive metal which forms an oxide layer that provides no significant protection from further oxidation. Thus the metal surface, initially cleaned under ultra-high vacuum conditions, is retained in the positive pressure inert gas environment used in the anaerobic cell.

Aluminum Sample Test Results

Core Level Spectra

Figures 4A, 4B, 4C:
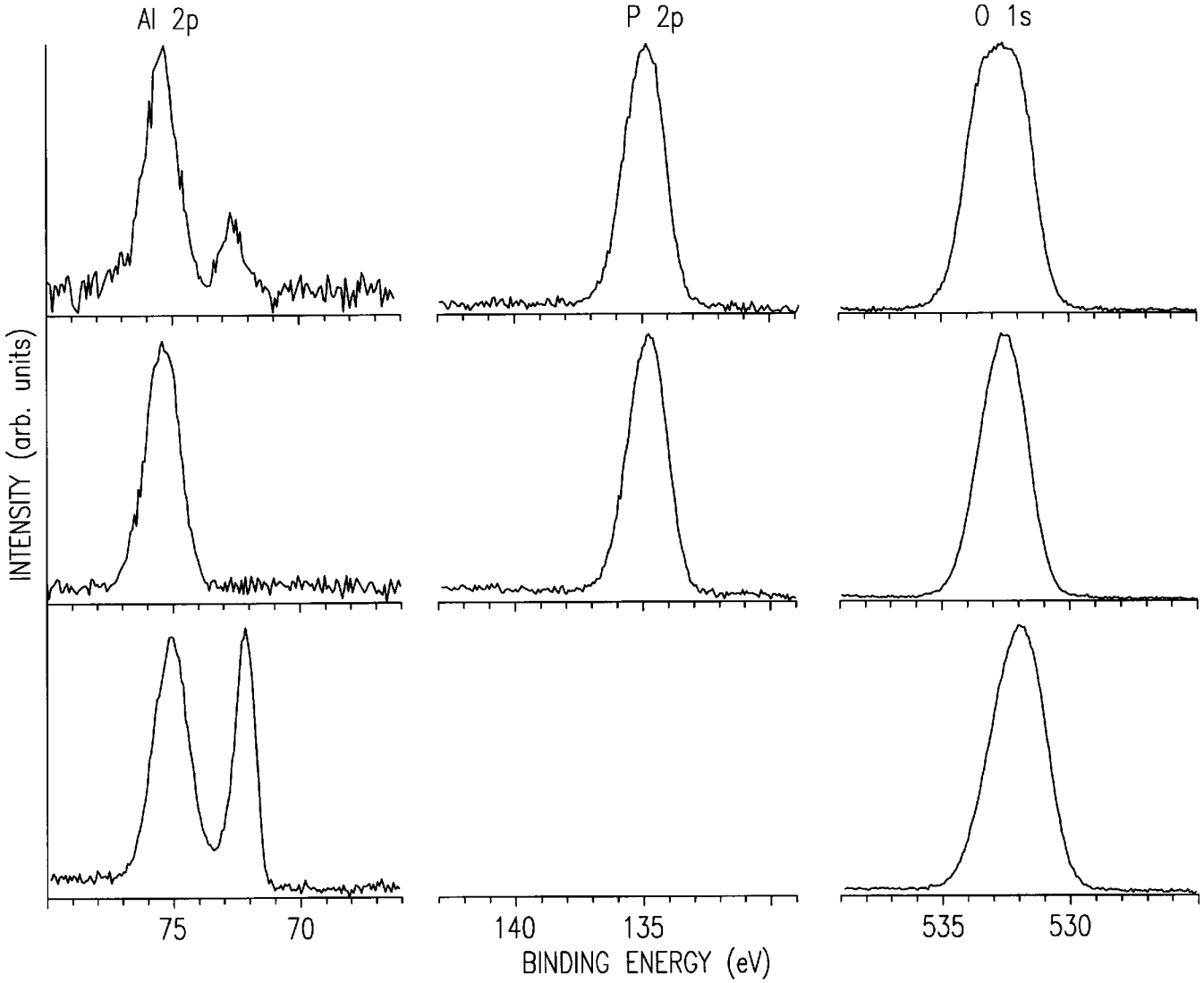
FIG. 4A is an XPS Al2p, P2p and O1s core level spectrum (wherein "arb units" refers to arbitrary units) of aluminum metaphosphate film formed in accordance with the invention.
FIG. 4B is an XPS Al2p, P2p and O1s core level spectrum (wherein "arb units" refers to arbitrary units) of aluminum metaphosphate film formed in accordance with the invention after a 2 week exposure to ambient atmosphere.
FIG. 4C is an XPS Al2p and O1s core level spectrum (wherein "arb units" refers to arbitrary units) of etched aluminum metal exposed to deoxygenated water for 10 min.

The Al2p, P2p, and O1s spectra for the electrochemically formed films on aluminum are shown in FIG. 4 with the Al2p and O1s spectra for the triply distilled water exposure. FIG. 4A represents the film formed directly after the electrochemical treatment. The film remained in an inert atmosphere of ultra high purity nitrogen gas during the experiment and was removed directly to ultra high vacuum for XPS analysis once the electrochemistry was completed. FIG. 4B represents the same sample after a two week period in ambient atmosphere. FIG. 4C shows the oxidation of an etched aluminum electrode after 10 minutes in triply distilled, deaerated water, without electrochemical treatment.

Al2p and P2p Spectra

The Al2p spectrum in FIG. 4A consists of a low intensity aluminum metal ($Al^0$) peak at a binding energy of 72.44 eV and a higher binding energy phosphate ($PO_4^{3-}$) peak at 75.22 eV. These values agree well with previously reported XPS data excited with monochromatic X-radiation for aluminum metal and aluminum metaphosphate powder. It is well known that the oxides, hydroxides and oxyhydroxides of aluminum are also shifted on the order of 2.8 eV from the metal, therefore it is not possible to use the Al2p chemical shifts to distinguish between phosphate and oxidized aluminum. The parallel experiment in FIG. 4A demonstrates this point. After argon ion etching, an aluminum electrode was exposed in the anaerobic cell to triply distilled water for 10 minutes. The Al2p shows a high binding energy oxide peak shifted from the low binding energy metal peak with the same chemical shift of the two phosphate films. Note, however, that these two features are of equal intensity whereas the Al2p spectrum for 10 minute electrochemical treatment in FIG. 4A shows the remnants of considerably less metal. The notable difference in these intensities suggest an increased amount of reaction at the electrode surface which is expected in the case of the electrochemical treatment.

Prolonged exposure to the atmosphere was observed to thicken the film as is evidenced by the absence of a metal peak in the Al2p spectrum of FIG. 4B. There was, as expected, no change in the Al2p core level binding energy. The P2p binding energies for the film before and after atmospheric exposure were both measured at 134.73 eV in good agreement with previously reported values for aluminum metaphosphate and aluminum phosphate powders which showed very similar P2p binding energies for these two compounds.

O1s Spectra

The O1s spectra of FIG. 4B contains one peak as would be expected for an aluminum phosphate film at a binding energy of 532.39 eV which corresponds to phosphate ($PO_4^{3-}$). The film formed before air exposure in FIG. 4A, however, shows a broad single envelope which would be best fit with two components.

An examination of the crystal structure of the film demonstrates that the presence of two peaks in the O1s spectrum of FIG. 4A is consistent with the presence of aluminum metaphosphate. Metaphosphates are compounds in which each $PO_4$ group shares two oxygen atoms to form rings of the composition. FIG. 5 demonstrates such an arrangement.

The $Al_8(P_4O_{12})$ crystal has a cubic unit cell containing sixteen molecules in a rather complicated structure. The phosphorous and oxygen atoms reside in an arrangement such that the $PO_4$ tetrahedra are linked to form a ringed $P_4O_{12}$ complex.

Within the tetrahedron the P-O distances vary between 1.39 and 1.60 Å. Within the ring, the oxygen atoms are equidistant from its two bonded ring phosphorous atoms. The other O atoms in the tetrahedra which lie outside of the ring also provide octahedra about the aluminum atoms at distances of 1.80 and 1.83 Å. The more tightly bonded oxygen atoms within the ring as evidenced by the shorter bond lengths result in a high binding energy peak in the O1s. The lower binding energy component is due to the oxygen atoms which lie outside of the ring structure. No evidence for oxide is found in the O1s core level.

Area Ratios of Core XPS Peaks

It is well known for the aluminum system that oxidized aluminum can be easily distinguished from the metal by a substantial Al2p core level XPS chemical shift, but different oxidized aluminum compounds studies show insignificant differences in chemical shift between one another. Nevertheless, the changes in the relative areas of the core XPS peaks provides useful information Table 1 presents the aluminum to phosphorus surface atomic ratios. The calculation of these ratios is based upon the assumption that the surface may be represented as an ideal homogenous Al/P mixed region. This approximation gives a valuable qualitative monitor of the composition changes in the surface film. The film formed after electrochemical treatment in 5M phosphoric acid before exposure to the atmosphere shows an atomic ratio between phosphorus and oxygen that is consistent with a film composition of $Al_8(P_4O_{12})$, aluminum metaphosphate. With subsequent exposure to air, a decrease in the Al/P ratio is observed which would be expected given the presence of a stable aluminum phosphate film. No evidence is found for the presence of oxide. The area obtained from the O1s region that gives an oxygen percentage is not used in this calculation because there are additional sources of oxygen such as chemisorbed oxygen and chemisorbed water whose necessary inclusion in the area calculation makes the area information of less value. If one makes the considerable assumption that the surface film is of uniform thickness and covers a metal substrate then the thickness of the film can be calculated based upon the intensity ratio of the Al2p peak corresponding to metal and the Al2p peak corresponding to oxidized aluminum or aluminum metaphosphate.

It is estimated that thickness of metaphosphate film is on the order of 96 Å. After exposure to atmosphere the metaphosphate film was observed to change to a thicker film of aluminum phosphate. Due to the thickness of the phosphate film, however, the Al2p spectrum excited with monochromatic Al Kα radiation contained only one peak corresponding to phosphate as shown in FIG. 4B. By taking advantage of the increased sampling depth of higher energy achromic titanium Kα radiation, it was possible to excite an Al1s spectrum consisting of both the metal and phosphate peaks necessary to calculate the film thickness. The thickness of the aluminum phosphate film in this test was estimated to be on the order of 105 Å.

TABLE 1

Approximate atomic ratios with respect to aluminum for the UHV formed phosphate film and the same film after exposure to atmosphere

| Element | Film at UHV | Film after Air Exposure |
|---|---|---|
| Phosphorous | 2.17 | 1.80 |
| Carbon | .970 | 1.26 |
| Oxygen | 5.69 | 3.81 |

Valence Band Spectra

Conclusive evidence for the chemical identity of the surface films may be provided by valence band photoemission. Valence band XPS has proved of particular value in the determination of the presence of phosphate. FIG. 1 presents an experimental spectrum of lithium phosphate powder with a synthetic phosphate ion spectrum generated by Xα calculation. Both the experimental and the calculated spectrum display two outstanding features at 10.3 and 13 eV. These two features represent conclusive evidence for the presence of phosphate ion, and agrees well with previous investigations. The valence band spectrum of phosphate can be easily distinguished from that of oxide. This is illustrated by a consideration of the difference in the valence band spectrum for the phosphate ion with features found in the valence band spectrum for oxidized iron and aluminum.

Distinguishing Between Oxidized Iron and Iron Phosphate

FIGS. 2A–2C present the experimental valence band spectra of iron oxyhydroxide and iron (III) oxide and ferric phosphate. There is a clear shift in the peak positions of the phosphate in FIG. 2C as compared to the hydroxide and oxide in FIGS. 2A and 2B. The ferric phosphate spectrum contains a very distinctive three peak structure whose position and relative peak intensities clearly identify the ferric phosphate and can distinguish between oxide and hydroxide.

Distinguishing Between Oxidized Aluminum and Aluminum Phosphate

The aluminum-oxygen-water system shows a similar striking difference between the corundum, aluminum phosphate and aluminum metaphosphate powder spectra as indicated in FIGS. 3A–3C. Both the phosphate and metaphosphate spectra contain three distinct features. The two characteristic phosphate peaks at 10.3 and 13 eV and a third peak near 7 eV. In aluminum phosphate the phosphate peaks are sharp and of equal intensity and the 7 eV peak is broad. The spectrum for metaphosphate is quite different. The 10.3 eV peak is broader and of greater intensity than the peak at 13 eV both of which are broader than those found in the aluminum phosphate spectrum. Finally, the third peak near 7 eV is narrow compared to the other two and compared to the same peak in aluminum phosphate. The energy position and shapes of peaks in the valence band provide clear indication of the presence of oxide or phosphate species and can distinguish between these chemically similar phosphate systems.

The valence band spectrum of the phosphate film is presented in FIG. 6B in comparison with an aluminum metaphosphate powder sample spectrum in FIG. 6A. Immediately evident in both spectra are the characteristic doublet features of the phosphate ion at 10.3 and 13 eV binding energy. Both spectra contain a third low binding energy feature at 8 eV. The full width at half maximums (FWHMs) of the O2s peaks of our film and metaphosphate powder at 25 eV are similar (6.03 eV and 6.54 eV, respectively). As expected, a slight broadening is present for the powder. The structure seen in valence band photoemission arises from the density of states in the solid. The similarity in peak structure, separation, and the like relative intensity of the components between the phosphate film and the aluminum metaphosphate powder clearly identify our UHV film as aluminum metaphosphate. This conclusion is supported by the core level data. Furthermore, with comparison to FIG. 3, there is no support for the presence of oxide in the valence band spectrum establishing that the phosphate film is in the unusual state of being bonded directly to the aluminum surface without any intermediate oxide.

A similar comparison is made of the valence band data for the aluminum phosphate powder in FIG. 7A to that of the UHV film after two weeks in ambient atmospheric conditions in FIG. 7B. With reference again to FIGS. 3A–3C, the film is clearly different from what is expected for aluminum metaphosphate while comparing extremely well to the powder spectrum of aluminum phosphate. Again, there is no evidence for the presence of oxide, and thus the directly bonded phosphate film is air stable.

Figures 12A, 12B:
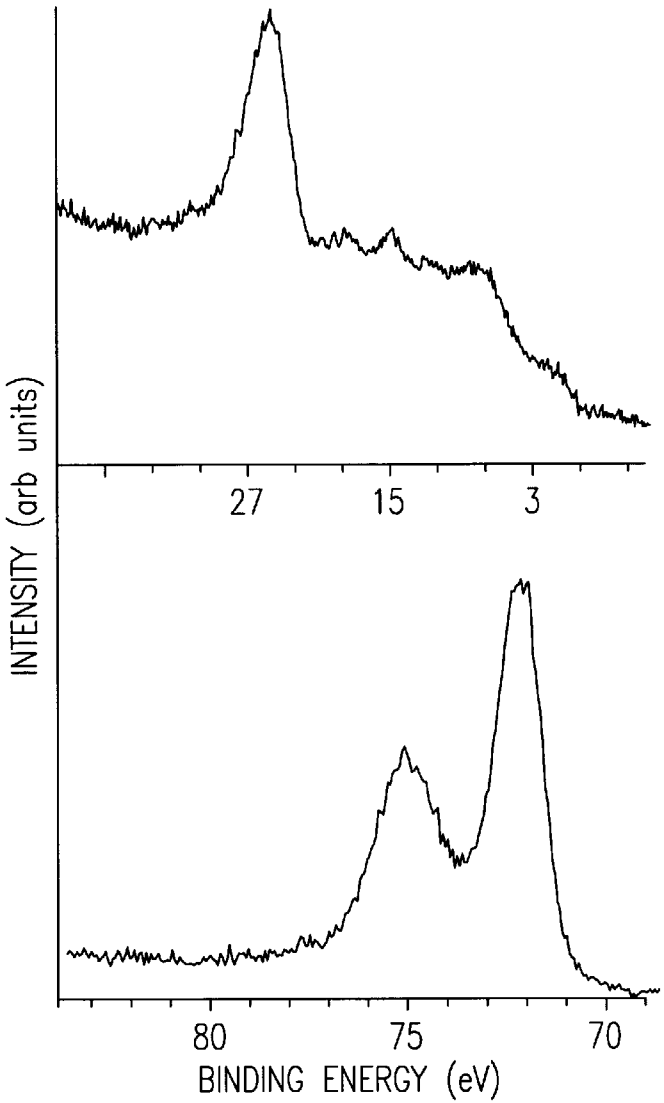
FIG. 12A is an XPS valence band spectrum (wherein "arb units" refers to arbitrary units) of films formed on an as received aluminum sample after conventional electrochemical deposition of a phosphate film on the sample in atmosphere.
FIG. 12B is an XPS Al2p spectrum (wherein "arb units" refers to arbitrary units) of the electrochemically treated aluminum sample referred to in FIG. 12A.

FIGS. 12A–12B show the result of performing the experiment in a conventional electrochemical cell with as received aluminum, without removal of naturally occurring aluminum oxides. The conventional cell was operated using deoxygenated water under a nitrogen atmosphere, and the resulting sample transferred through air for XPS analysis. The XPS result shows (FIG. 12B) an Al2p region that indicates that the oxide film has thinned with a substantial increase in the intensity of the metal peak around 72 eV. The valence band region (FIG. 12A) indicates the presence of metal, oxide and some phosphate on the metal surface. This experiment confirms that when the experiment is performed with a metal with an air formed oxide film, this oxide film is reduced in thickness, but a phosphate film is not formed directly on the metal and oxide is always present.

Iron Sample Test Results

Core Level Spectra

Figure 8:
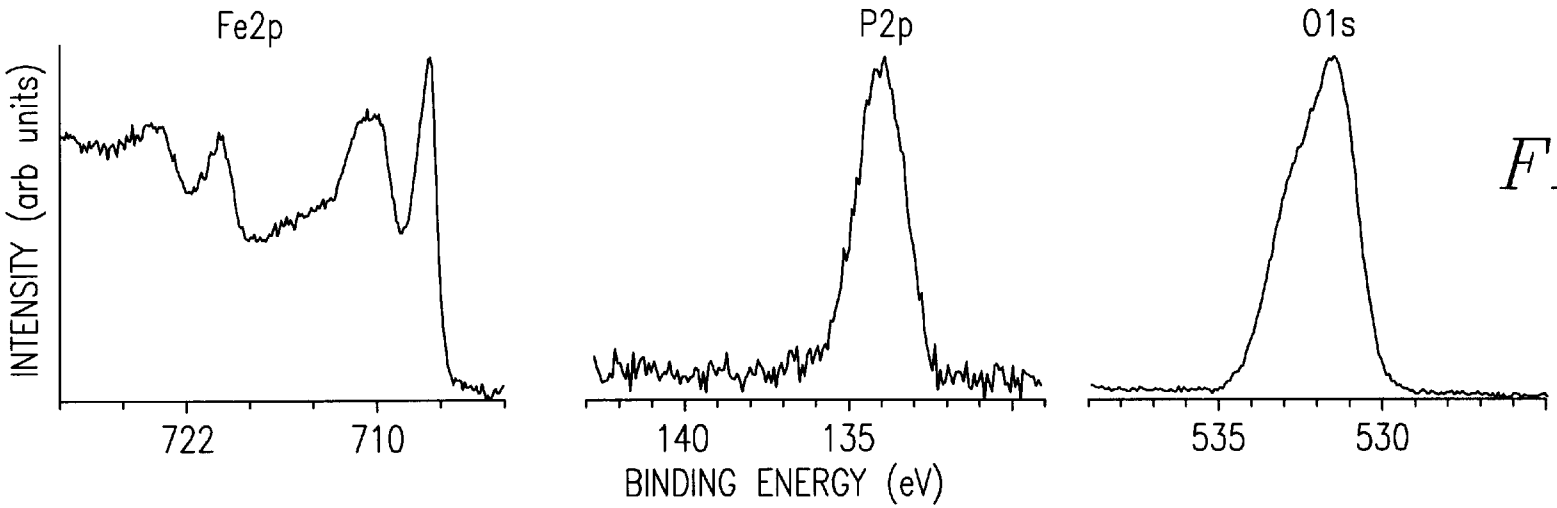
FIG. 8 is a representation of XPS Fe2p, P2p, and O1s core level spectrum (wherein "arb units" refers to arbitrary units) for a ferric phosphate film produced in accordance with the invention.

The Fe2p, P2p, and O1s spectra for the electrochemically formed films on iron are shown in FIG. 8, representing the film formed directly after the electrochemical treatment. As with the aluminum electrode, the iron electrode film remained in an inert atmosphere of ultra high purity nitrogen gas during the experiment and was removed directly to ultra high vacuum for XPS analysis once the electrochemistry was completed.

Fe2p and P2p spectra The Fe2p spectrum in FIG. 8 consists of two pairs of spin orbit split peaks giving a four peak structure. The low binding energy pair of peaks measured at 706.42 eV and 710.19 eV binding energy correspond to the $Fe2p_{3/2}$ metal and metal phosphate peaks respectively. The $Fe2p_{1/2}$ metal peak was measured at 719.63 eV and that for the phosphate at a binding energy of 723.40 eV. The Fe2p core levels are quite broad and as in the case of aluminum these shifts cannot be used to clearly distinguish between the presence of phosphate or oxide. However an intense P2p feature is observed for the iron electrode measured at a binding energy of 133.85 eV which corresponds to phosphate ($PO_3^{3-}$).

O1s Spectra

The O1s spectrum for the iron film shown in FIG. 8 consists of a phosphate ($PO_3^{3-}$) peak at a binding energy of 531.44 eV. There is a clearly visible shoulder on the higher binding energy side of the peak. The shoulder is believed to be adsorbed water, as its measured binding energy of 533.11 eV is consistent with other published values for water adsorbed at metallic electrode surfaces.

Valence Band Spectra

FIG. 9B illustrates the XPS spectra for the phosphate-iron film. FIG. 9A is the valence band spectrum of ferric phosphate powder. The presence of ferric phosphate is clearly demonstrated by the three peak structure to the high binding energy side of the iron metal edge. The energy positions and relative intensities of these peaks are indicative of a surface ferric phosphate film. It is estimated that the film thickness is on the order of 30–40 Å. No evidence is found for the presence of any metal oxide, and thus the phosphate film is bonded directly to the metal surface without any intermediate oxide.

FIG. 10B is the valence band spectrum of the UHV formed ferric phosphate film after 3 months in ambient atmosphere. This spectrum appears identical in terms of peak structure, peak position, peak separation, and relative intensities as a spectrum of ferric phosphate powder shown in FIG. 10A. This conclusively shows that the film in FIG. 10B is that of ferric phosphate with no oxide identifiable.

As with the aluminum system, the UHV formed film was thickened upon exposure to atmosphere as is demonstrated by the loss of the clear metal edge in FIG. 11B to a spectrum that corresponds to that of the ferric phosphate valence band as shown by our air exposed film spectrum in FIG. 11C (the same spectrum as shown in FIG. 10B). There is no evidence for the presence of oxide in these spectra. FIG. 11A shows a spectrum obtained when the same experiment is performed in a conventional electrochemical cell in the laboratory. In this case the metal is examined in its as received condition, without the prior removal of surface oxide in the anaerobic cell. In this case the spectrum clearly indicates the presence of both phosphate and oxide. An examination of FIGS. 2A–2C supports this interpretation, for the iron oxides have a significant peak at lower binding energy to that found in the phosphate, and this peak is clearly seen as a shoulder in FIG. 11A. FIG. 11A is thus a sum of the valence band spectrum of ferric phosphate and ferric oxide. There is no metallic iron present in FIG. 11A as can be seen by comparison with FIG. 11B which shows the low binding energy peak near the Fermi level corresponding to metallic iron, which is absent in FIG. 11A.

We claim:

1. A body having a surface presenting metal surface atoms, a preponderance of said metal atoms being directly chemically bonded with phosphate groups in the absence of metal oxide between the metal atoms and the phosphate groups, said metal atoms being selected from the group consisting of the first row of transition metals, the second row of transition metals, the rare Earth metals, Hf, Ta, W, Re and the metals of Group III.

2. The body of claim 1, said metal being selected from the group consisting of Al and Fe.

3. The body of claim 1, said body being formed of solid metal.

4. The body of claim 1, said phosphate groups forming a phosphate layer having a thickness of from about 20–100 Å.

5. The body of claim 4, said thickness being from about 20–60 Å.

6. The body of claim 5, said period being at least about 2 weeks.

7. The body of claim 4, said layer being stable in atmospheric air at ambient temperatures for a period of at least about 24 hours.

8. The body of claim 1, at least about 75% of the number of said metal surface atoms being directly bonded to said phosphate groups.

9. The body of claim 8, at least about 95% of the number of said metal surface atoms being directly bonded to said phosphate groups.

10. A method comprising the steps of:

providing a body having a surface presenting metal surface atoms, said metals atoms being selected from the group consisting of the first row of transition metals, the second row of transition metals, the rare Earth metals, Hf, Ta, W, Re and the metals of Group III;

removing oxides from said surface; and directly bonding phosphate groups to at least some of said surface metal atoms in the absence of metal oxide between the metal atoms and the phosphate groups.

11. The method of claim 10, said metal being selected from the group consisting of Al and Fe.

12. The method of claim 10, said body being formed of solid metal.

13. The method of claim 10, said phosphate groups forming a phosphate layer having a thickness of from about 20–100 Å.

14. The method of claim 13, said layer being stable in atmospheric air at ambient temperatures for a period of at least about 24 hours.

15. The method of claim 14, said period being at least about 2 weeks.

16. The method of claim 13, said thickness being from about 20–60 Å.

17. The method of claim 10, at least about 75% of the number of said metal surface atoms being directly bonded to said phosphate groups.

18. The method of claim 17, at least about 95% of the number of said metal surface atoms being directly bonded to said phosphate groups.

19. The method of claim 10, wherein said removing step comprises argon ion etching said metal surface to remove said oxides.

20. The method of claim 19, said argon ion etching being carried out under a pressure of from about $10^{-9}$ to $10^{-10}$ Torr.

21. The method of claim 10, including the step of electrochemically depositing said phosphate groups on said surface to effect said bonding between the phosphate groups and said surface metal atoms.

22. The method of claim 21, said electrochemical depositing step being carried out under an inert, essentially oxygen-free atmosphere.

* * * * *